United States Patent [19]

Schaefer

[11] Patent Number: 4,762,509

[45] Date of Patent: Aug. 9, 1988

[54] SHOCK-SAFE FUSEHOLDER ASSEMBLY

[75] Inventor: Rudolf K. Schaefer, Des Plaines, Ill.

[73] Assignee: Littelfuse, Inc., Des Plaines, Ill.

[21] Appl. No.: 926,611

[22] Filed: Nov. 12, 1986

[51] Int. Cl.[4] ..... H01R 13/68

[52] U.S. Cl. ..... 439/621; 337/195; 439/670

[58] Field of Search ..... 339/90 R, 90 F, 90 C, 339/147 R, 147 P, 188 R, 188 C, 188 T, 189 R, 189 L, 190, 203; 337/195, 198, 201, 213, 225, 228; 439/314–319, 621, 622, 670–674, 729

[56] References Cited

U.S. PATENT DOCUMENTS

| | | | |
|---|---|---|---|
| 1,493,988 | 5/1924 | Kerwin | 339/188 R |
| 1,602,227 | 10/1926 | Hentschel | 337/195 |
| 2,572,448 | 10/1951 | Child | 339/188 C |
| 2,704,356 | 3/1955 | Herterick | 339/188 C |
| 4,072,385 | 2/1978 | Wallner | 337/236 |
| 4,453,794 | 6/1984 | Wallner et al. | 439/621 |
| 4,486,067 | 12/1984 | Wallner et al. | 29/878 |
| 4,504,815 | 3/1985 | Harwath | 339/147 R |
| 4,508,412 | 4/1985 | Daggett | 339/203 |
| 4,536,054 | 8/1985 | Wallner et al. | 439/621 |

FOREIGN PATENT DOCUMENTS

| | | | |
|---|---|---|---|
| 0173845 | 3/1986 | European Pat. Off. | 339/90 R |
| 9296 | 9/1956 | Fed. Rep. of Germany | 339/90 R |
| 613552 | 11/1926 | France | 337/213 |

*Primary Examiner*—Gil Weidenfeld

*Assistant Examiner*—Gary F. Paumen

*Attorney, Agent, or Firm*—Russell E. Hattis; Stephen R. Arnold

[57] ABSTRACT

A bayonet lock for retaining the knob of a fuseholder to an axial-insertion fuseholder body is formed by camming surfaces disposed in the walls of grooves formed in the walls of the insertion passage and on the surfaces of a knob extension which enters the passage. The engaging surfaces of the lock are of insulating material. Axial insertion and rotation of the knob retains an inserted fuse. Camming surfaces are provided so that upon rotation of the fuseholder knob in an unlocking direction, these camming surfaces cause an automatic outward ejection of the fuseholder knob. Additional camming surfaces are provided to assist in insertion so that when operator pressure is released from the knob, the knob compression spring forces the knob axially outward into engagement therewith, the surfaces being configured to provide a force urging the knob in the locking direction. A conducting fuse end cap contacting sleeve is configured at the closed end thereof to grippingly engage an axial post extending inwardly into the fuse-accepting passageway. The post is configured to extend significantly along the axis of an axially disposed compression spring. The length of the post is chosen so that knob insertion is terminated when the post strikes the outer end of an overlength inserted fuse, thereby preventing damaging overcompression of the spring.

23 Claims, 4 Drawing Sheets

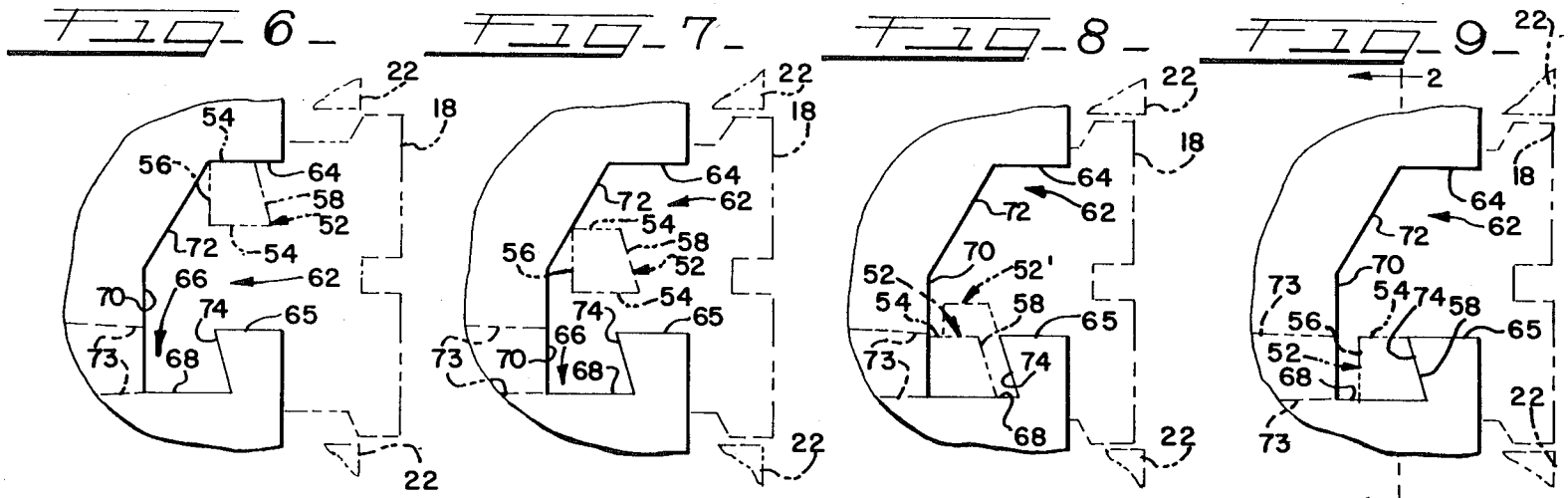
FIG. 6
FIG. 7
FIG. 8
FIG. 9
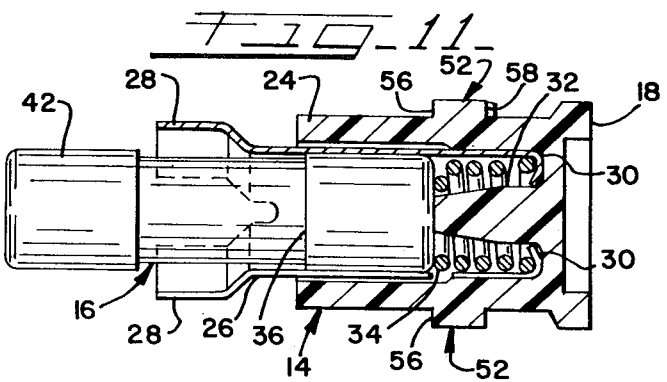
FIG. 11
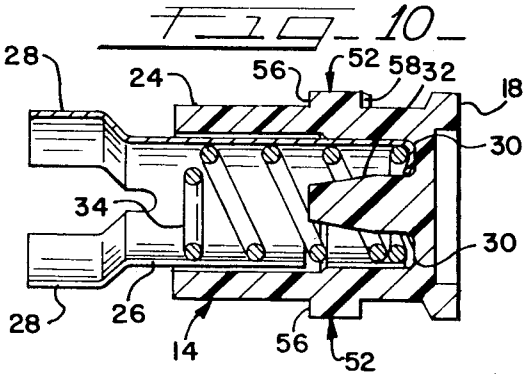
FIG. 10

SHOCK-SAFE FUSEHOLDER ASSEMBLY

TECHNICAL FIELD

The technical field of the invention is the automatic circuit-breaking art, and in particular electrical fuses.

BACKGROUND OF THF INVENTION

One commonly used form of electrical fuseholder assembly includes a socket-forming body designed to be mounted on a panel so as to accept insertion of fuses from the front of the panel. The fuse is carried and held in place by a knob of one form or another which fits into an opening on the front of the body. Frequently such knobs have a bayonet-type retention lock, i.e., a retention lock configured with locking members so that the knob is first axially inserted to a certain depth into the body opening against the force of a fuse-retaining spring and then rotated to a position so that upon removal of the insertion pressure the retaining spring forces the locking members into locking engagement. Removal of the knob is achieved by first pressing axially inward on it to separate the locking members, then rotating the knob in a direction opposite to the locking direction, and then releasing the pressure thereon, whereupon the retaining spring force ejects the knob from the body.

Such fuseholder assemblies permit rapid insertion of the fuse-carrying knob as compared with alternative types wherein screw threads are provided on the knob and body. The former type of fuseholder assembly is shown in the patent literature, as for example, in U.S. Pat. No. 4,448,476 issued May 15, 1984 to Perlman et al. Such assemblies typically include a conducting sleeve coaxially mounted in the fuseholder knob and carrying an axial spring mounted therewithin, the socket-forming body having an electrical side terminal contact which is configured to lockingly engage with the sleeve so as to provide not only the mechanical locking action, but also electrical contact from the side terminal to the outer end of an inserted fuse.

Such fuseholder assemblies typically exhibit a variety of drawbacks. First, the use of the two metallic structures to form the locking means and the electrical contact as well can give rise to undesirably high contact resistance between the locking members. This arises from the fact that, particularly in the case of high amperage fuses, fuseholders may run rather hot. Since there are normally many plastic insulating portions in the fuseholder assembly, the result is that the engaging surfaces of the locking members may become contaminated by organic compounds volatilized from the plastic. Additionally, such locking means are fragile, and if the knob is not fully inserted prior to rotation, portions of the lock member elements may be improperly engaged after rotation of the knob and become deformed so as to become inoperative.

An additional problem arises in such fuseholder assemblies in that they tend to be unstable in the event of incomplete final rotation of the knob during insertion, i.e., if the knob is not sufficiently rotated that the fuse-retaining spring is able to move the knob slightly outward to the locking position, then subsequent vibration may allow the fuse knob to rotate to a point where the knob is undesirably ejected.

In addition to the instability associated with the use of conventional bayonet lock means to retain the fuse knob in the fuseholder body, a further problem is commonly experienced when the fuseholder knob has a screwdriver slot head which, when the knob is in place and finally positioned within the fuseholder body, does not project beyond the outer surface of the fuseholder body (or would not do so in the absence of spring pressure). The knob can be removed by inserting a screwdriver into the slot in the knob head and rotating it into its unlocked position where spring pressure forces the knob outward where it can be grasped and removed from the fuseholder body. However, it is not an uncommon experience for an operator to extract a suspect fuse, find that it is blown, and place the knob back in the holder temporarily while he goes off to find a replacement fuse. At this point the customary knob spring pressure bearing on the fuse, which normally will eject the knob in the released orientation thereof as described above, is missing. Thus, upon attempting to remove the knob with the spring in this relaxed condition by rotating the knob with a screwdriver, the user finds that the knob remains depressed within the fuseholder body where he cannot grasp it. A sharply pointed knife or the like is then needed to pry or pull the knob out of the fuseholder body.

A similar situation is also encountered in those cases where the pressure spring is carried within a conducting sleeve mounted as an extension of the knob assembly, and wherein the fuse end cap accommodated therein has become so corroded so as to freeze to the sleeve. Under such conditions the spring force cannot act against the fuse to assist in the extraction of the knob.

Finally, it is well known that there exist a great variety of fuses manufactured in cartridges of identical diameter, but of different length. If a fuse of accidentally oversize length is inserted into a conventional axial fuseholder, then upon forcing the fuse knob inward to retain the fuse, the axial spring may easily be stressed to the point of permanent deformation. This results in reduced axial seating pressure when a fuse of proper length is installed thereafter. This can cause a fuseholder to run hot at the terminals because of inadequate seating pressure to maintain the contact.

SUMMARY OF THE INVENTION

A fuseholder configured for axial insertion of cartridge-type fuses comprises a socket-forming body having a fuse-accepting passageway or socket and a fuse-retaining knob. The body passageway and the knob preferably have complementary portions configured for guiding engagement when the knob is forced axially inward, usually against the force of an ejecting spring. In accordance with one aspect of the invention, circumferential motion guiding means are provided in the passageway, preferably on the insulating walls thereof and the knob is provided with corresponding outwardly extending projections, formed preferably on an insulating knob extension which enters the passageway. Coaxially mounted in the knob extension is a conducting sleeve for receiving and making contact with the outer end of the fuse in the preferred form of the invention, engaging surfaces on portions of the passageway guide grooves are configured so that initial insertion of the knob is constrained substantially to nonrotating axial movement until the knob is in a nearly seated position. Helical camming surfaces preferably part of said guide grooves, are arranged so that as the seated knob is pushed fully inward against a spring force, the knob is cammingly rotated by said camming surfaces into a position where either by a further manual rotation, or by release of axial pressure on the knob without a forced rotation, the knob is in a position where the spring which creates said spring force urges the knob outwardly into an interlocked position with an inwardly facing locking shoulder on the fuseholder body. If the knob has been inserted without a fuse in the knob, the spring force referred to is not present, as previously explained. However, in accordance with the present invention, if such a knob is rotated by a screwdriver from its locked to its unlocking direction, the knob projections will engage said camming surfaces, which will then guidingly urge the knob into a position where it extends beyond the plane of the insertion aperture of the fuseholder body where it can be readily grasped by the operator for convenient removal.

Another advantage of the preferred form of the invention just described is that the interlocking surfaces of the knob and fuseholder body described are insulated from the current-carrying portions of the fuseholder. In some prior art fuseholder structures the axially facing interlocking surfaces are current-carrying surfaces which can cause general overheating of the assembly to cause distillation of organic matter to contaminate the conducting surfaces.

The applicant knows of no fuseholder having the camming and insulating bayonet-type features just described. The only prior art known to the applicant which has a cam-like guide is used for a completely different purpose than the present invention, and is constructed so as not to be applicable to a fuseholder. Thus, U.S. Pat. No. 3,477,062 issued to Wagstaffe shows a half-turn helical-lock type lamp bulb holder configured to lockingly to accept the base of a lamp bulb having a pair of radially extending bosses on the base thereof. The bulb holder, which is obviously not event remotely useful with a fuse, is always expected to be grooved and so does not have the problem solved by the unique fuseholder of the invention just described. Moreover, the bulb holder receptacle relates to the bulb holder in a substantially different manner than the fuseholder body of the invention. For example, the bulb holder receptacle is a metal sleeve configured with a pair of boss-receiving half-turn helical slots. When the bosses are inserted in the grooves, the lamp is immediately rotated, and when the knob bosses reach the end of the grove, the bosses are trapped by a groove enlargement. This sleeve serves as a spring to urge the bosses, and hence the base of the lamp, having a pair of projecting contacts on the inner end thereof, into contact with a pair of outwardly facing terminals in the bulb holder. Clearly the lamp holder of this patent would not be considered to be relevant prior art to a fuseholder, and is substantially structurally different from the fuseholder of the invention described.

According to a further feature of the invention, additional inwardly facing camming surfaces are provided so that during knob insertion and rotation to a locking condition, upon release of the axial insertion pressure the ejecting force of the fuse-retaining spring causes the knob assembly to be further urged in the locking direction. By this means the possibility of accidental later ejection of the knob arising from incomplete locking rotation by the operator is substantially eliminated.

According to a further feature of the invention, in the event that the operator fails to force the fuseholder knob sufficiently into the assembly to rotate the locking portions into confronting engagement, no capture whatever occurs, and the knob will be immediately ejected upon release of pressure thereto, thus notifying the operator that he has failed to seat the assembly properly. If, on the other, sufficient rotation has occurred that even a partial locking engagement occurs, on release of axial insertion pressure to the fuseholder knob the knob assembly is automatically urged towards full locking engagement.

According to a further feature of the invention, a safety feature is provided which effectively prevents permanent damaging compression of an axial pressure spring carried in the fuseholder knob. As is well known in the art, a conducting sleeve in the knob which carries and makes contact to the outer end of an inserted fuse frequently carries the axial pressure spring integrally contained therein. At the end of the sleeve which resides outermost in the knob, i.e., closest to the outer face of the knob, there are provided retention fingers. A central inwardly extending axially disposed tapered post is provided on the inwardly facing surface of the knob, and is configured to engagingly pass between these fingers when the sleeve is pressed against this inwardly facing surface of the knob during assembly, to be captively retained thereon. This same post is configured to extend partially along the length of the compression spring, and is deliberately made sufficiently long that if an oversized fuse is inserted into the assembly, and the knob is then pushed in for engagement, the post will strike the outer end cap of the fuse so as to prevent engagement of the locking system, and further to prevent permanent compressive damaging deformation to the spring.

Other features and aspects of the invention will become apparent upon making reference to the specification, claims, and drawings to follow.

DESCRIPTION OF THE DRAWINGS

FIG. 6 is a circumferential foldout view of the body portion shown in FIG. 2, further showing in phantom outline a locking boss shown in FIG. 9 partially axially inserted to engage a camming portion on the wall of the fuseholder body, and further showing the relative positions of the mounting flange and knob in phantom outline.

FIG. 7 shows a further phase of insertion beyond that shown in FIG. 6, showing a camming rotation of the locking boss.

FIG. 8 shows the final stage of rotation indicated in FIG. 7, the locking boss having been rotated to full rotation.

FIG. 9 shows the final phase of locking engagement of the boss with the fuseholder boss of FIGS. 6, 7, and 8 with the fuseholder body, axial pressure having been removed from the structure.

FIG. 10 is a cross-section view of the knob shown in FIG. 5 using the form of sleeve shown in FIGS. 3 and 4.

FIG. 11 shows the structure of FIG. 10 with a fuse compressingly inserted against an arresting stop.

DESCRIPTION OF THE INVENTION

Figure 1:
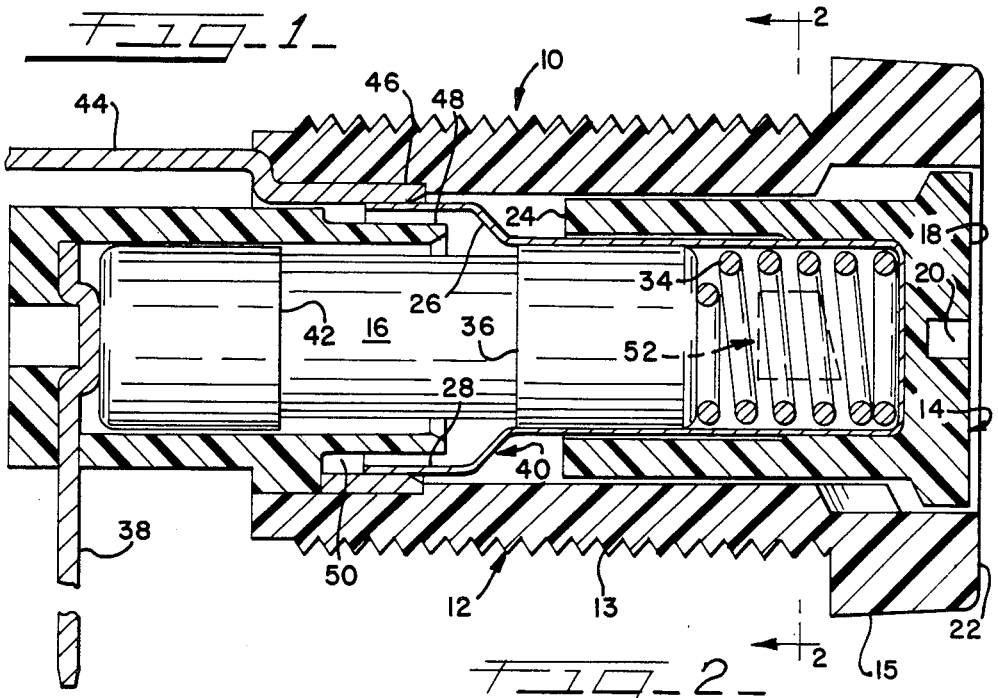
FIG. 1 is a partially cutaway cross-section view of the fuseholder of the present invention with a fuse inserted, the structure consisting generally of a body having a panel mounting flange, and an inserted knob assembly.

FIG. 1 shows a representative fuseholder assembly 10 consisting of a body 12 captively retaining a knob 14. The body includes a threaded insulating sleeve 13 integral with an apertured mounting collar 15 having an outer face 22. The customary retention nut configured to engage the sleeve 13 for mounting purposes is not shown. The knob 14 is held in place by locking means to be discussed subsequently to retain an inserted fuse 16. In this position the outer surface 18 of the knob 14 is generally coplanar with the outer face 22 of the body 12. A screwdriver slot 20 is centrally located in the knob outer face 18. For purposes of all subsequent discussion, the term "inward" or "inner" will refer to directions deeper towards the interior of the fuseholder 10, and the term "outer" will refer to regions closer disposed to the outer faces 18 and 22. Similar terminology will be applied to the knob 14.

The knob 14 features an insulating cylindrical inwardly extending shroud extension 24 within which is captively secured a conducting sleeve 26 having cylindrical expanded skirt portions 28 at the inner end thereof, and in the preferred form (see FIGS. 3, 4, 10, and 11) has radially extending tension fingers 30—30 at the outer end thereof. These fingers are configured for securely gripping an axially inwardly extending post 32 during assembly to hold the sleeve 26 securely emplaced within the shroud 24. A compression spring 34 is secured at the outer (rightmost) end of the interior of the sleeve 26 by press-in insertion, the inner end of the spring being compressively engaged against the outer end cap (terminal) 36 of the fuse 16. The spring 34 thus serves the purpose that when the fuse 16 is inserted the fuse 16 is pressed inward against a end cap contact 38 at the inner end of the fuse insertion passage 40, so as to establish good contact with the inner end cap 42 of the fuse.

Furthermore, when the knob 14 is rotated to a unlocked condition, as will subsequently be discussed, the spring 34 serves to eject the knob outward to a point where it may readily be grasped and removed by the operator, simultaneously removing the fuse 16. It should be noted at this point that if no fuse is present, no such ejecting force will be applied to the knob 14, with the result that removal of a knob of the type shown, having an outer surface 18 depressed within or flush with the body face 22, will be difficult to remove. As will subsequently be shown, the instant invention provides a positive knob extraction feature irrespective of whether a fuse is present or not.

External contact to the outer end cap 36 of the fuse 16 via the sleeve 26 is secured by means of an end cap contact 44 having as an interior portion 46 configured in the form of a ring coaxially disposed in the insertion passage 40, and positioned so that the skirt portions 28 of the sleeve 26 make wiping contact thereto. To prevent the inner end cap 42 of the fuse 16 from contacting this side ring 46 during fuse insertion or withdrawal, an insulating shroud 48 is provided integral with the body assembly and coaxially disposed to extend along a central portion of the insertion passage 40 so as to confront the interior surfaces of the terminal ring 46. The outer radius of the shroud 48 is chosen so as to leave an annular passage 50 leading past the inner surface of the ring to allow insertion of the skirt portions 28 of the sleeve 26.

Figure 5:
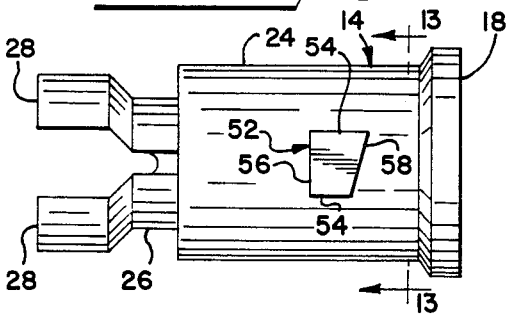
FIG. 5 is a plan view of the knob assembly shown in FIG. 1.
Figure 3:
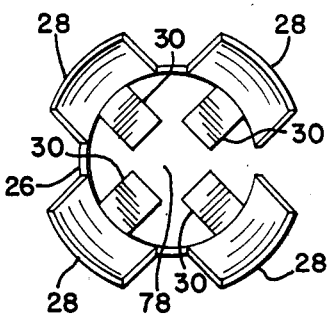
FIG. 3 is an end view of one form of contacting sleeve for accepting the outer end of a fuse.
Figure 4:
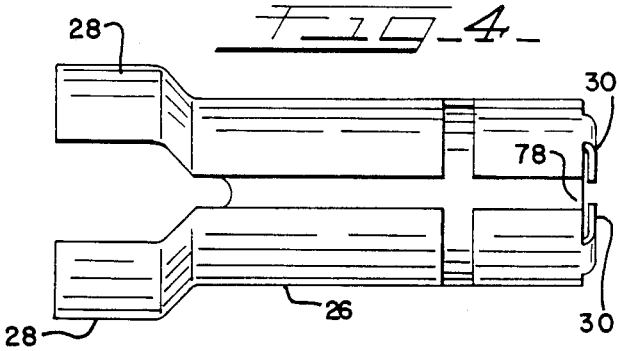
FIG. 4 is a plan view of the sleeve shown in FIG. 3.
Figure 12:
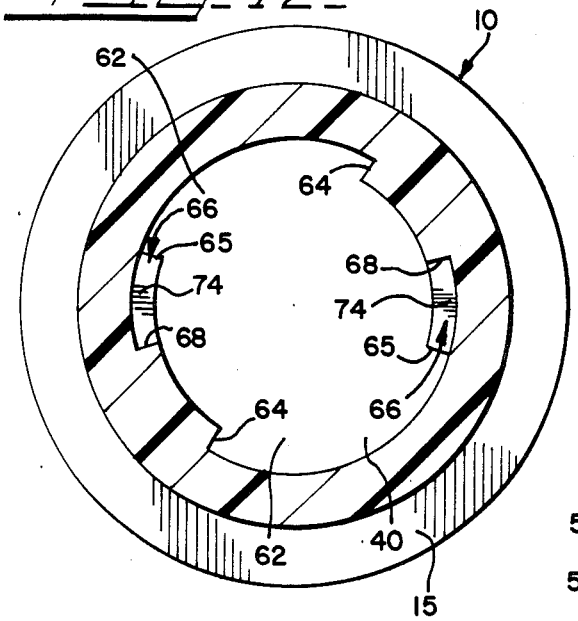
FIG. 12 is a cross-section view of the fuseholder body along the cut lines shown in FIG. 14, showing locking shoulders for holding the knob in position.
Figure 13:
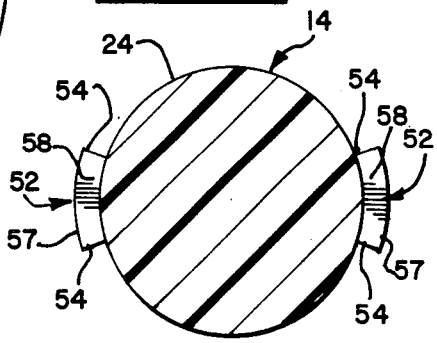
FIG. 13 is a cross-section view of the knob taken along the cut lines shown in FIG. 5, and showing a pair of knob locking projections.

Details of the locking structure of the present invention are best shown in FIGS. 2, 5–9, and 12–15. FIGS. 5 and 13 show the knob 14, having a pair of locking lugs (locking projections) 52 diametrically disposed on and extending outward from the outer cylindrical surface of the knob shroud extension 24 and having cylindrical outer faces 57. Each of the lugs 52 is configured with axially extending side facets 54 joined at their inner ends by an inner facet 56 disposed generally perpendicular thereto. The outer ends of the side facets 54—54 are joined by a generally outwardly facing facet 58 oriented as shown in FIG. 5 to present an inclined side profile.

Figure 14:
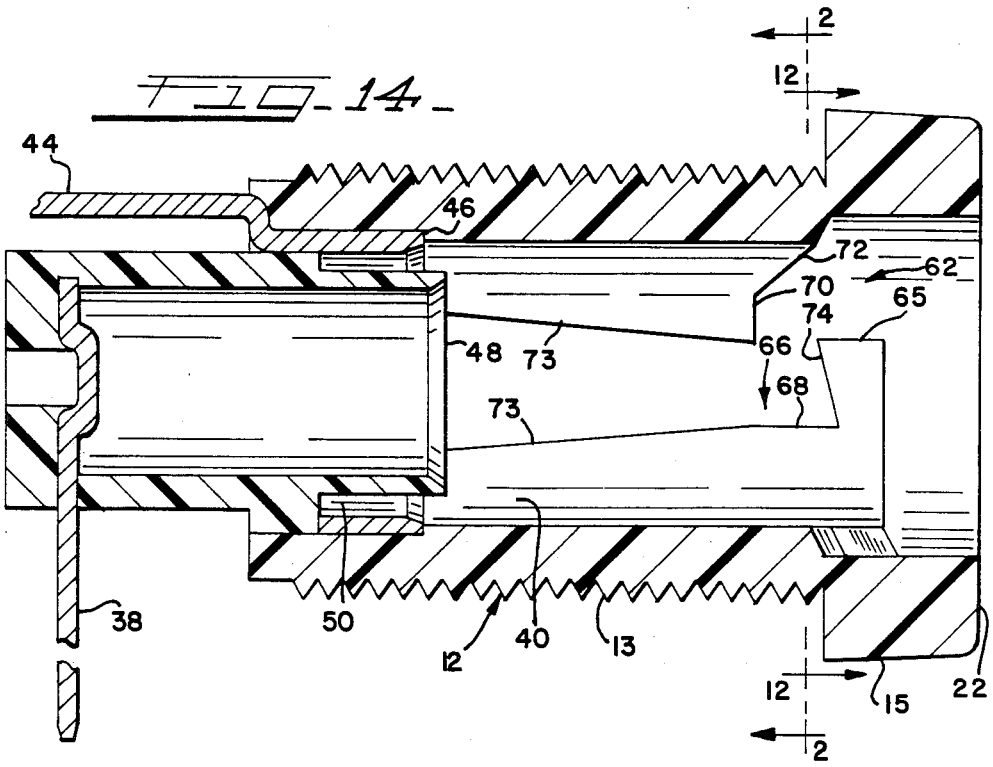
FIG. 14 is a cross-section view similar to FIG. 1, but with the fuse and knob removed.
Figure 15:
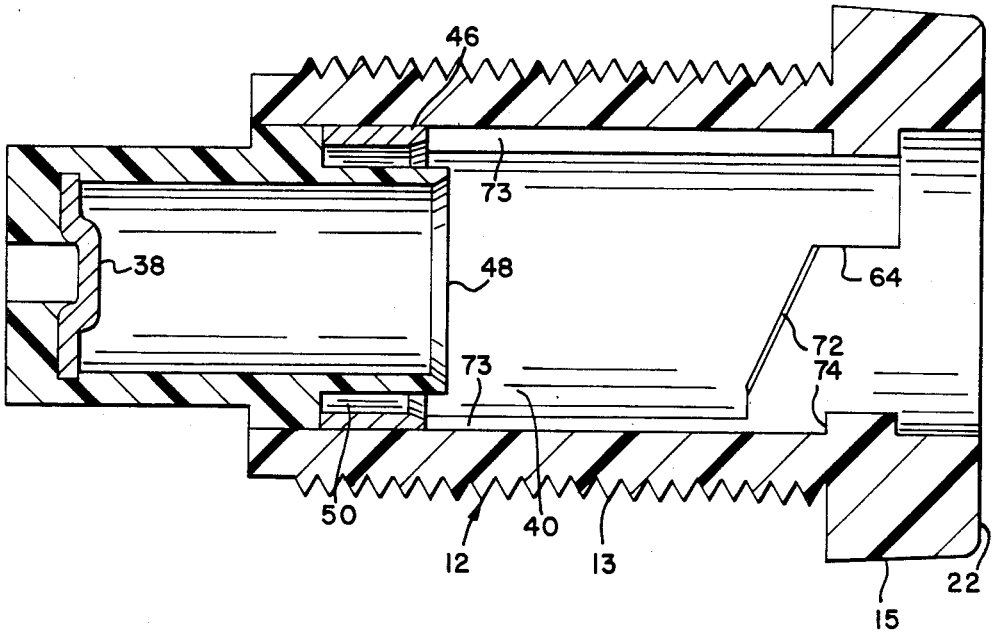
FIG. 15 is a cross-section view similar to FIG. 14, but rotated approximately 90 degrees.

FIGS. 14 and 15 show cross-section views of the fuseholder body 12 as shown in FIG. 1, but with the fuse and knob removed. The principal details of the locking structure are shown in FIGS. 14 and 15, as well as in the circumferential fold-out view of FIG. 2. Lines 73—73 in FIGS. 6–9, 14 represent optional molding grooves which facilitate the manufacturing process, but which bear no relevance to the locking system. These optional groove boundaries are shown in dotted outline in FIGS. 6–9.

To maintain alignment of the knob 14 during insertion thereof, a pair of axial grooves 62—62 (FIG. 12) are formed along interior walls of the fuse insertion passage 40 so as to form a pair of channels (referred to in the claims as entry sections) extending axially inward along the walls of the insertion passage 40, and having opposing side walls 64,65. Insertion of the knob assembly 14 with the locking lugs 52 generally centered between the walls defining these grooves 62 (referred to in the claims as entry section walls) will allow for generally axially confined sliding engagement of the knob assembly 14 into the fuseholder body 12.

With particular reference to the fold-out view of FIG. 6, it will be seen that the interior end of each axial groove 62 joins a generally transversely disposed short radially extending circumferential terminal groove 66 (referred to in the claims as terminal section) further provided in the interior walls of the insertion passage 40, this circumferential groove terminating in a circumferentially facing end wall 68. The radially inwardly extending groove 66 is generally defined by an axially outwardly facing inner wall 70 joining the axial groove side wall 64 by an inner axially outwardly facing helical camming surface 72 (see FIG. 2) making an angle with respect to the wall 70, and by an axially inwardly facing locking shoulder-forming camming surface 74 (FIG. 12) which has a helical curvature in the opposite direction (because it is an oppositely facing surface) as that of the helical camming surface 72 (referred to in the claims as first helical camming surface).

Figure 2:
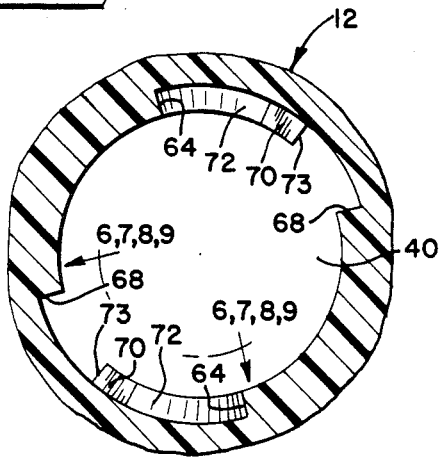
FIG. 2 is a partial cross-section end view of an inner portion of the body indicated by cut lines in FIG. 1, with central body elements and peripheral portions of the flange removed.

When the knob 14 is initially inserted, each locking lug 52 will be generally axially guided until a corner of the interior facet 56 of each lug strikes the inner camming surface 72, at which time rotary displacement automatically occurs, i.e., the lug 54 will then proceed to cam downward as shown in FIGS. 6 and 7 corresponding to a clockwise rotation with respect to the orientation shown in FIG. 2. Each locking lug 52 is preferably placed in an orientation so that upon full axial insertion automatic rotation positions its outer facet 58 to establish at least a partially confronting overlap with respect to the inclined camming surface 74 (referred to in the claims as second helical camming surface) of its associated radially extending groove 66. In the event that the operator should fail to induce full manual clockwise rotation of the knob assembly 14 on insertion, release of insertion pressure to the knob assembly will cause it to be urged axially outwardly by the spring 34 to place the outer facet of the lug 58 at least in partially overlapping confronting engagement with the helical camming surface 74 of the radially extending groove 66, as shown in phantom outline 52' in FIG. 8. The spring 34 will thus have the effect of continuing to supply a clockwise rotating force with respect to the orientation of FIG. 2 to the knob assembly to urge the locking lugs 52 towards their final seated position shown in FIG. 9.

Two benefits are immediately evident from such a configuration of the engaging surfaces. First, the capture system is inherently stable, i.e., provided the knob assembly 14 has rotated far enough to establish any kind of capture condition, the tendency of the system, either alone or assisted by vibration, is to move towards a more stable locking configuration. Prior art systems known to the applicant do not provide this; they typically provide the functional equivalent of a pair of inner and outer facets placed at right angles to the side facets 54,54. The result is that if the operator should fail to rotate them to a fully seated condition, but merely establishes initial partial confronting contact of the type shown in phantom outline 52' in FIG. 8, then subsequent vibration can easily cause the knob to rotate back to an ejecting position. A well-recognized mode of failure is thus avoided. It is equally evident that if no such overlap is initially achieved, the knob 14 will immediately be ejected, thus warning the operator to seat the knob 14 again.

This feature is advantageous as applied either to flush- or depressed-type fuseholders as shown in FIG. 1, having a knob outer surface 18 generally depressed within or coplanar with the body outer face 18, or in the alternative as applied to fuseholders wherein the knob 14 is provided with a large, readily-gripped knob extension extending substantially outward beyond the fuseholder body outer face.

Second, it is evident by inspection of FIGS. 6–9 that if the knob has been inserted and moved to a locking orientation with no fuse in the passageway 40, then a screwdriver rotation of the knob 14 in the unlocking direction will cause the locking lugs 52 to rotate so that junction with flush-type mounting system as shown in FIG. 1.

Referring next to FIGS. 3, 4, 10, and 11, it will be noted that the conducting fuse-retaining sleeve 26 is preferably fabricated from a properly configured piece of resilient sheet stock material. In particular, it will be noted that the radially extending fingers 30—30 are generally coplanarly disposed to define between the terminal ends thereof an aperture 78. The fingers 30 are dimensioned so that during fuse assembly sleeve 26 is forced over a axially disposed tapered post 32 of the knob 14. Full insertion of the sleeve 26 into the shroud extension 24 causes these fingers 30—30 to lockingly engage the tapered post 32 to place portions of the fingers generally in confronting contact with the interior wall of the shroud 24 immediately adjacent the base of the tapered post 32. As previously mentioned, the spring 34 is press-fitted so that the outer end thereof is captively secured in position against the inner surfaces of the sleeve 26 close to the fingers 30—30, leaving the inner end thereof free for axial movement against the end cap 36 of an inserted fuse 16.

The post 32 is deliberately configured overlength so as to provide a useful safety feature. As mentioned in the Background of the Invention and Summary of the Invention, if one inadvertently attempts to lock the knob 14 over the wrong kind of fuse, i.e., a fuse having proper diameter for acceptance into the insertion passage 40, but being too long for proper operation therein, upon axial insertion of the knob 14, the post 32 will arrestingly strike the outer end cap 36 of the inserted fuse 16 to prevent further insertion of the knob as shown in FIG. 11. Thus, the spring 34 cannot be overcompressed by an oversized fuse to the point where it suffers permanent compressive deformation. Similarly, it is equally evident that by proper configuration of the various camming surfaces shown in FIGS. 6–9 locking engagement with an overlength fuse in place will be impossible.

This reduces the possibility of a type of subsequent malfunction encountered in prior art structures not having this protective feature, where a proper length fuse is subsequently inserted and the knob locked thereto. Such a permanently over-compressed spring frequently cannot thereafter apply adequate seating pressure to the fuse, as a result of which inferior contact will frequently be experienced, particularly with respect to the fuse inner end cap 42 contacting the inner terminal contact 38. Insufficient pressure gives rise to inadequate contact, which in turn gives rise to undesirably high temperature operation of the fuse body in the vicinity of this contact.

Thus, there has been provided a fuseholder of the bayonet-type which provides an instantaneous warning that proper locking has not been achieved, which provides for positive stable locking even in the case of incomplete rotation of the knob, which provides a positive camming extraction feature forcing the knob outward even when no fuse is inserted, and which further the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. In a fuseholder body made of insulating material and having a fuse-receiving passageway extending axially inwardly from an outer face thereof for receiving a cartridge-type electrical fuse, said body having first and second axially spaced terminal means for providing external electrical connection to the inner and outer contacts respectively of an inserted fuse, the improvement wherein:

said body is configured for use with a fuse-retaining knob used for carrying said fuse and having at least one radially extending locking projection configured for axial insertion into said passageway with said knob, said knob having a head with an outer face with turning tool-receiving means and which, when the knob is fully inserted into said passageway, can be disposed generally flush or recessed with respect to said outer face of said body, one of said body and said knob to include resilient biasing means for exerting an ejecting force on said knob by means of a fuse so inserted, said passageway having a statonary knob locking projection-receiving portion with an entry section having entry section walls for initially guiding said knob locking projection and a terminal section for retainingly accepting said knob locking projection, the entry section of said passageway having a first helical camming surface made of insulating material and which is engaged by an axially inwardly facing portion of said knob locking projection to guide the knob during insertion for rotation towards a locking position with not more than substantially one-half turn of the knob, said terminal section of said knob locking receiving portion of said passageway having a longitudinally axially inwardly facing wall forming a locking shoulder, said first helical camming surface having a sufficient extent so that when said knob is inserted into said passageway and pushed inwardly said knob is turned in a locking direction by engagement of said knob locking projection and said first helical camming surface and said knob locking projection will confront said locking shoulder and be urged by said biasing means against said locking shoulder to retain said body against said ejecting force when said knob is no longer being pushed inwardly, said first helical camming surface when said knob is rotated to turn the knob from its locked to an unlocked position being traversed by said locking projection so as to eject said knob from said passageway even when a fuse is removed from the body and the biasing means is unable to eject the knob.

2. The fuseholder body of claim 1 further including a second helical camming surface on said locking shoulder of said body disposed to be in a confronting relationship with said knob locking portion when said knob is in said locking position so as to prevent extraction of said knob by said biasing means, said second helical camming surface being configured to rotatingly urge said knob in said locking direction by the ejecting force of said biasing means.

3. The fuseholder body of claim 2 wherein said second helical camming surface of said locking shoulder portion is inclined to the longitudinal axis of said body so that when only a partial confrontation is achieved between said locking shoulder and said knob locking projection arising from incomplete rotation of said knob to said locking position said knob is urged in said locking direction by the ejecting force of said biasing means pressing the knob locking projection against said second helical camming surface.

4. The fuseholder body of claim 3 wherein said locking shoulder is disposed so that if such partial confrontation is not achieved attendant to fuse insertion, said knob remains freely axially movable, so that removal of said axial insertion pressure will cause ejection of said knob by said biasing means.

5. The fuseholder body of claim 4 in combination with said knob, wherein said knob locking projection is configured as a faceted boss having a pair of oppositely disposed facets generally parallel to the axis of insertion of said knob so as to slidingly confront said entry section walls, a joining facet joining said pair of parallel facets and disposed for confronting engagement with said first helical camming surface during axial insertion of said knob, and an angled facet joining said pair of parallel facets and disposed to confrontingly face said second helical camming surface of said locking shoulder in parallel relationship thereto when said knob is in said locking position.

6. The fuseholder body of claims 1, 2, 3, 4, 5 combined with said knob, said knob having a fuse-carrying extension including a conducting sleeve configured to receive the outer terminal of the fuse.

7. The fuseholder body and knob combination of claim 6 wherein said conducting sleeve includes said resilient biasing means in the form of compressible spring means disposed therein for exerting axial inwardly directed pressure against an inserted fuse, mounting means for securing said sleeve to said knob, post means disposed on said knob and projecting axially into said sleeve, said post means having a length chosen to arrestingly engage said outer terminal of said fuse at a chosen compression condition of said spring means.

8. The fuseholder of claim 7 wherein said sections of said portions of said passageway are configured so that such arresting engagement prevents sufficient knob insertion to allow rotation of said knob to said locking position.

9. The fuseholder of claim 7 wherein said conducting sleeve further includes at least one gripping member disposed at the outer end of said sleeve for grippingly engaging said post means to attach said sleeve thereto.

10. The fuseholder of claim 9 wherein a plurality of said gripping members are provided, said members extending generally radially inward from said end of said sleeve, the lengths of said members being chosen to define an insertion aperture for said post defined by the inner ends of said members.

11. The fuseholder body of claims 1, 2, 3, 4 in combination with said knob.

12. The fuseholder body and knob combination of claim 6 wherein said fuse-carrying extension includes a portion made of insulating material and said at least one locking projection is configured as an insulating extension thereof.

13. The fuseholder body and knob combination of claim 6 wherein said fuse-carrying extension includes a portion made of insulating material and said at least one locking projection is configured as an insulating extension thereof, said insulating portion of said extension being configured as a sleeve configured to accept said conducting sleeve.

14. The fuseholder body of claim 1 wherein said locking shoulder is insulated from current-carrying structures so that electrical current cannot pass between said locking shoulder and said knob locking projection.

15. The fuseholder of claim 14 in combination with said knob wherein both said locking shoulder and said knob locking portion are so insulated from current carrying structures that electrical current cannot pass therebetween.

16. In combination, a fuseholder body and a fuse-retaining knob, said fuseholder body being insulating material and having a fuse-receiving passageway extending inwardly from an outer face thereof for receiving a cartridge-type electrical fuse, said body having first and second terminal means for providing external electrical connection to the inner and outer contacts respectively of an inserted fuse, said fuse-retaining knob adapted to carry said fuse and having at least one radially extending locking projection configured for axial insertion into said passageway with said knob, one of said body and said knob including resilient biasing means for exerting an ejecting force on said knob through a fuse so inserted, said passageway having a knob locking projection-receiving portion with an entry section having entry section walls for initially guiding said knob locking projection and a terminal section for retainingly accepting said knob locking projection, said terminal section of said knob locking receiving portion of said passageway having a longitudinally axially inwardly facing wall forming a locking shoulder, so that when said knob is inserted into said passageway and said knob is turned in a locking direction, said knob locking projection will confront said locking shoulder and be urged by said biasing means against said locking shoulder to retain said body against said ejecting force, the improvement comprising:

said locking shoulder being configured with a camming surface disposed to be in a confronting relationship with said knob locking projection when said knob is in said locking position so as to prevent ejection of said knob by said biasing means, said camming surface being configured to rotatingly urge said knob in said locking direction by the ejecting force of said biasing means pressing said knob locking projection against said camming surface, the initially confronting portions of said camming surfaces of said locking shoulder and said knob locking projection beng configured so that when insertion pressure on said knob is released when said knob locking projection begins to partially overlap said locking shoulder camming surface, said camming surface under the force of said biasing means will rotate the knob in said locking direction to lock said knob in place, and upon release of said knob before said partial overlapping takes place, said biasing means will press said knob into a position where it projects beyond said fuseholder body.

17. The combination of claim 16 wherein said camming surface is configured so that when only a partial confrontation is achieved between said locking shoulder and said knob locking projection arising from incomplete rotation of said knob to said locking position said knob is urged in said locking direction by the ejecting force of said biasing means.

18. The combination of claim 17 wherein said locking shoulder is disposed so that if such partial confrontation is not achieved attendant to fuse insertion, said knob remains freely axially movable, so that removal of axial insertion pressure will cause ejection of said knob by said biasing means.

19. The combination of claim 16, wherein said knob locking projection is configured as a faceted boss having a pair of oppositely disposed facets generally parallel to the axis of insertion of said knob so as to slidingly confront said entry section walls, and an angled facet joining said pair of parallel facets and disposed to confrontingly face said camming surface of said locking shoulder in parallel relationship thereto when said knob is in said locking position.

20. In combination, a fuseholder body made of insulating material and having a fuse-receiving passageway extending axially inwardly from an outer face thereof for receiving a cartridge-type electrical fuse, said body having first and second axially spaced terminal means for providing external electrical connection to the inner and outer contacts respectively of an inserted fuse, a fuse-carrying knob inserted in said fuseholder body passageway, said knob having fuseholder body interlocking means for releasably locking said knob to said body when said knob is fully inserted into said passageway, said knob including a conducting sleeve configured for insertion into said passageway, a first cartridge fuse with terminals at the opposite axial ends, the outer end of said fuse being received in and electrically connected with said sleeve, the inner terminal of said fuse electrically contacting the other of said first and second terminals, said sleeve including compressible spring means disposed therein for exerting axial pressure against the inserted fuse, and mounting means for securing said sleeve to said knob, the improvement comprising:

a post mounted on said knob and projecting substantially axially into said sleeve, said post being axially spaced from said fuse and having a length chosen to arrestingly engage the outer terminal of a fuse of much greater length than said first fuse before the longer fuse could be fully inserted into a fuseholder body.

21. The fuseholder of claim 20 further including at least one gripping member disposed at the outer end of said sleeve for grippingly engaging said post to attach said sleeve thereto.

22. The fuseholder of claim 21 wherein a plurality of said gripping members are provided, said members extending generally radially inward from said outer end of said sleeve, the lengths of said members being chosen to define an insertion aperture for said post defined by the inner ends of said members.

23. In a fuseholder body made of insulating material and having a fuse-receiving passageway extending axially inwardly from an outer face thereof for receiving a cartridge-type electrical fuse, said body having first and second terminal means for providing external electrical connection to the inner and outer contacts respectively of an inserted fuse, the improvement wherein:

said body is configured for use with a fuse-retaining knob used for carrying said fuse, said knob having a head with an outer face with turning tool-receiving means and which, when the knob is fully inserted into said passageway, can be disposed generally flush or recessed with respect to said outer face of said body and further having at least one locking projection having an axially inwardly facing portion, one of said body and said knob including resilient biasing means for exerting an ejecting force on said knob by means of a fuse so inserted, said passageway having a stationary knob locking projection-receiving portion including a first helical camming surface disposed to be engaged by said axially inwardly facing portion of said knob locking projection to guide the knob during insertion for rotation towards a locking position with not more than substantially one-half turn of the knob, said knob locking receiving portion in said passageway having a longitudinally axially inwardly facing locking shoulder, said first helical camming surface having a sufficient extent so that when said knob is inserted into said passageway and pushed inwardly said knob is rotated in a locking direction by engagement of said knob locking projection and said first helical camming surface whereby said knob locking projection will confront said locking shoulder and be urged by said biasing means against said locking shoulder when said knob is retained by said ejecting force, said helical camming surface when said knob is rotated to turn the knob from its locked to an unlocked position being traversed by said locking projection so as to eject said knob from said passageway when no fuse is present in the body and the biasing means is unable to eject the knob.

* * * * *